US010894439B2

(12) United States Patent
Self

(10) Patent No.: US 10,894,439 B2
(45) Date of Patent: Jan. 19, 2021

(54) BILLWHEEL

(71) Applicant: Darrel Eugene Self, Kannapolis, NC (US)

(72) Inventor: Darrel Eugene Self, Kannapolis, NC (US)

( * ) Notice: Subject to any disclaimer, the term of this patent is extended or adjusted under 35 U.S.C. 154(b) by 0 days.

(21) Appl. No.: 16/683,198

(22) Filed: Nov. 13, 2019

(65) Prior Publication Data

US 2020/0147995 A1 May 14, 2020

Related U.S. Application Data

(60) Provisional application No. 62/760,926, filed on Nov. 14, 2018.

(51) Int. Cl.

| | |
|---|---|
| ***B42F 17/30*** | (2006.01) |
| ***B42F 17/34*** | (2006.01) |
| ***B42F 21/00*** | (2006.01) |
| ***B42F 17/18*** | (2006.01) |

(52) U.S. Cl.

CPC ..... *B42F 17/30* (2013.01); *B42F 17/18* (2013.01); *B42F 17/343* (2013.01); *B42F 21/00* (2013.01)

(58) Field of Classification Search

CPC ..... B42F 17/30; B42F 17/18; B42F 17/343; B42F 17/346; B42F 21/00; G09F 11/04

See application file for complete search history.

(56) References Cited

U.S. PATENT DOCUMENTS

| | | | | | |
|---|---|---|---|---|---|
| 1,728,584 | A * | 9/1929 | Wright | G09B 19/02 | 434/198 |
| 1,912,881 | A * | 6/1933 | Barnett | B42F 21/00 | 40/315 |
| 2,016,445 | A * | 10/1935 | Massey | G09F 11/04 | 40/495 |
| 2,493,134 | A * | 1/1950 | Gruden | G09F 11/04 | 40/109 |
| 2,792,993 | A * | 5/1957 | Schramm | G06G 1/0005 | 235/88 M |
| 3,419,973 | A * | 1/1969 | Manotas | G09B 19/02 | 434/198 |
| 3,471,956 | A * | 10/1969 | Walters | G09F 11/232 | 40/495 |
| 3,928,922 | A * | 12/1975 | Rosenbaum | G09B 3/04 | 434/322 |
| 4,008,533 | A * | 2/1977 | Greenberger | G09F 11/04 | 40/495 |
| 4,594,070 | A * | 6/1986 | Stoddard | G09F 11/04 | 116/309 |

(Continued)

*Primary Examiner* — Gary C Hoge

(74) *Attorney, Agent, or Firm* — Michael J. Foycik, Jr.

(57) ABSTRACT

A device provides a way to organize papers, folders, and bills or invoices. It also provides a way to set a status for such documents, such as pending or paid, and other status notations. And, it provides a way to provide a reminder that is inexpensive and easy to use. The device includes a manually rotatable wheel disposed inside a holder, the holder having first and second windows for viewing indicia. The rotatable wheel has indicia disposed on an outer ring for display through the first window, and has indicia disposed on an inner ring for display through the second window. The first window is a top window, and indicates status of the bill. The second window provides indicia which is explanatory of the indicia appearing in the first window.

6 Claims, 8 Drawing Sheets

(56) References Cited

U.S. PATENT DOCUMENTS

| | | | | |
|---|---|---|---|---|
| 5,057,067 | A * | 10/1991 | Hibsch | B31D 1/0075 283/65 |
| 5,447,769 | A * | 9/1995 | Bromberg | G09F 11/04 235/78 R |
| 2002/0139022 | A1* | 10/2002 | Gross | G09F 11/23 40/495 |
| 2004/0244245 | A1* | 12/2004 | Abdelrahman | G09F 11/04 40/495 |
| 2009/0241389 | A1* | 10/2009 | Puisis | G09F 11/23 40/495 |
| 2009/0288321 | A1* | 11/2009 | Firestone | G09F 11/04 40/447 |
| 2011/0209366 | A1* | 9/2011 | Chao | G09F 11/23 40/446 |
| 2017/0330491 | A1* | 11/2017 | Koludrovic | G09F 15/0056 |

* cited by examiner

BILLWHEEL

CROSS REFERENCE TO RELATED APPLICATIONS

This application claims the priority of Provisional Application No. 62/760,926 filed on Nov. 14, 2018, entitled "BILLWHEEL", having inventor Darrel Eugene Self. The entire disclosure of this provisional patent application is hereby incorporated by reference thereto, in its entirety.

STATEMENT REGARDING FEDERALLY SPONSORED RESEARCH OR DEVELOPMENT

Not applicable.

FIELD OF THE INVENTION

The present invention relates to a reminder device for organizing documents such as invoices, bills, and other items.

BACKGROUND OF THE INVENTION

It is a problem in the art to organize papers, folders, and bills or invoices, for example. It is also a problem to set a status for such documents, such as pending or paid, and other status notations. And, it is a problem to provide a reminder device that is inexpensive and easy to use.

SUMMARY OF THE INVENTION

From the foregoing, it is seen that it is a problem in the art to provide a device meeting the above requirements. According to the present invention, a device is provided which meets the aforementioned requirements and needs in the prior art.

Specifically, the device according to the present invention provides a device organize papers, folders, and bills or invoices, for example. It is also a device to set a status for such documents, such as pending or paid, and other status notations. And, it is a device to provide a reminder device that is inexpensive and easy to use.

The device of the present invention includes a manually rotatable wheel disposed inside a holder, the holder having first and second windows for viewing indicia. The first window is a top window, and indicates status of the bill. The second window provides indicia which is explanatory of the indicia appearing in the first window.

Other objects and advantages of the present invention will be more readily apparent from the following detailed description when read in conjunction with the accompanying drawings.

DETAILED DESCRIPTION OF THE INVENTION

Figure 1:
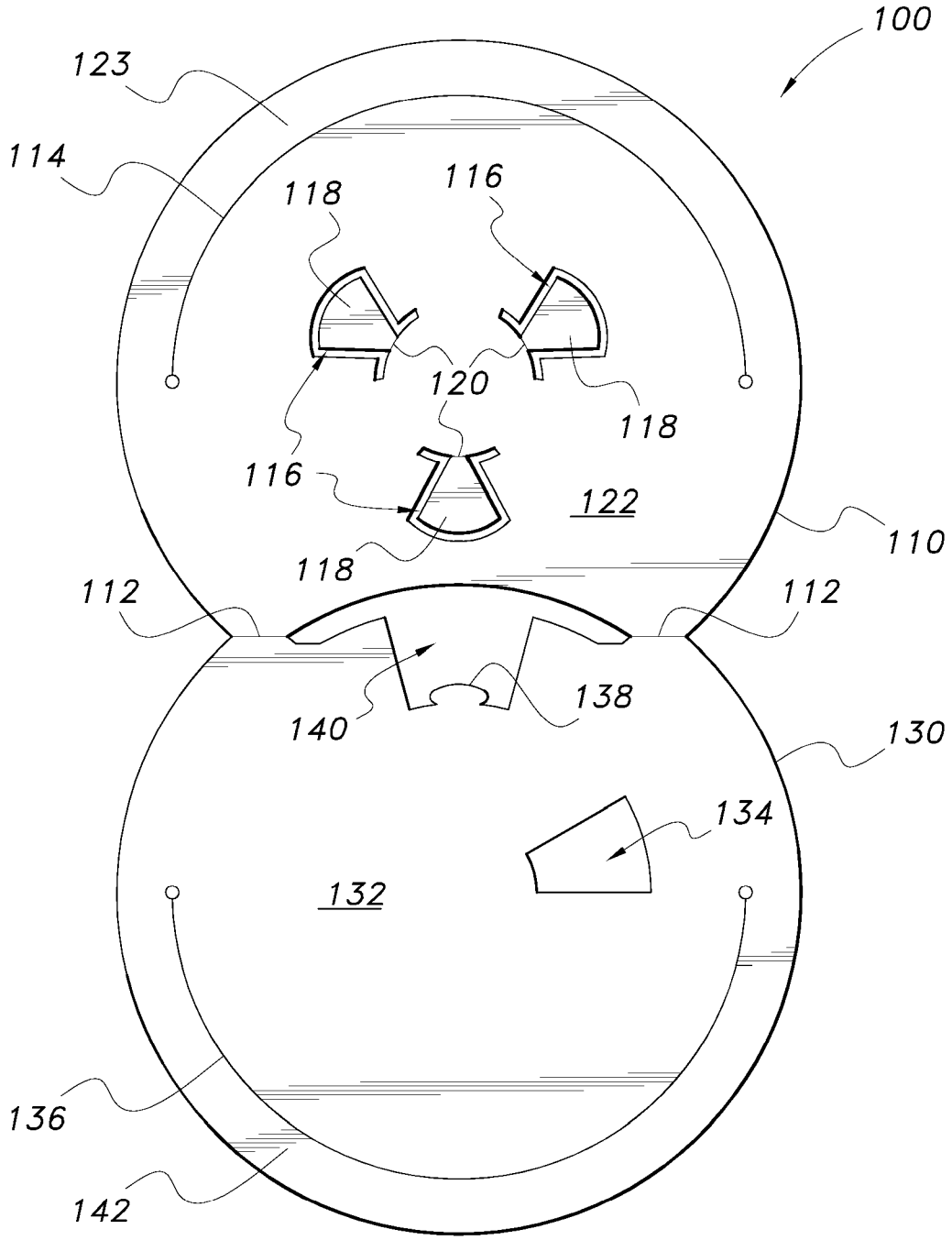
FIG. 1 is a front elevational view of a foldable blank, suitable for forming a holder according to the present invention.

FIG. 1 is a front elevational view of a foldable blank suitable for forming a holder for a device 100 according to the present invention. The device 100 is also referred to herein as a Billwheel 100. The foldable blank of FIG. 1 includes a first portion 110 and a second portion 130 connected by a pair of foldable parts 112, 112. When folded, the first portion 110 comes into facing engagement with the second portion 130.

The first portion 110 has a surface 122, a curved slit 114 forming a semicircular arc, and a portion 123 disposed along a periphery of a free end of the first portion 110. There are three tabs 118, 118, 118 defined by a cut 116. The cut 116 can for example be in the form of a punched-out portion; in the form of a weakened section such as a line of small perforations; and in the form of a cut slit.

The second portion 130 has a surface 132, a first window 140, a second window 134, a curved slit 136 in the form of a semicircular arc, and a portion 142 disposed at the free end of the second portion 130. A tab portion 138 extends in the first window 140, and is bendable so as to be insertable into cutout portions of the wheel 200 (indicated generally by numerals 211 and 212 in FIG. 3) to hold the wheel 200 in place once the user has moved the wheel 200 to a selected position.

Figure 2:
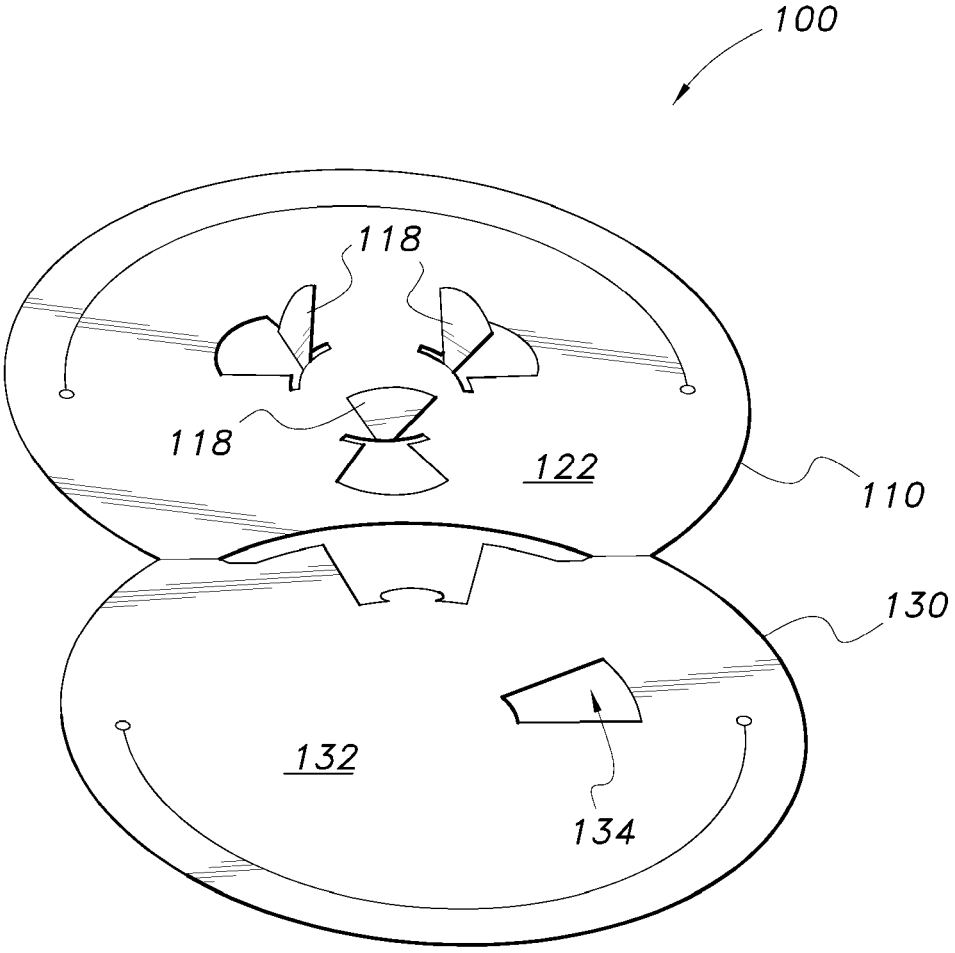
FIG. 2 is a front perspective view of the foldable blank of FIG. 1, showing tabs raised from the blank.

FIG. 2 is a front perspective view of the foldable blank of the device 100 of FIG. 1, showing tabs 118, 118, 118, raised from the surface 122 of the first portion 110.

Figure 3:
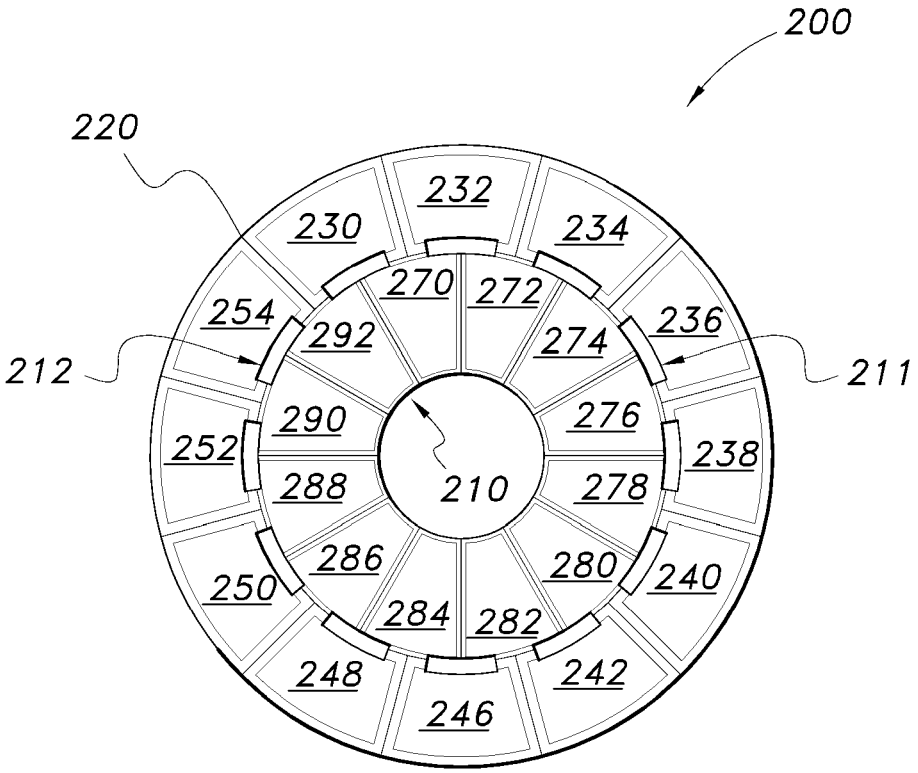
FIG. 3 is a front elevational view of a wheel according to the present invention, having indicia of a first type in an outer ring, and having indicia of a second type of indicia disposed in an inner ring.

FIG. 3 is a front elevational view of the wheel 200, having a central opening 210 sized to receive the tabs (118, 118, 118) of FIG. 2, and having slots (211, 212) disposed at intervals at a predetermined radius from a center of the wheel 200. The slots 211, 212 are adapted to receive the portion 138 which can be depressed and folded to pass into a selected one of the portions 211, 212.

The wheel 200 has indicia (230, 234, 236, 238, 240, 242, 246, 248, 250, 252, and 254) of a first type disposed in an outer ring, and has a second type of indicia (270, 272, 274, 276, 278, 280, 282, 284, 286, 288, 290, and 292) disposed in an inner ring.

Figure 4:
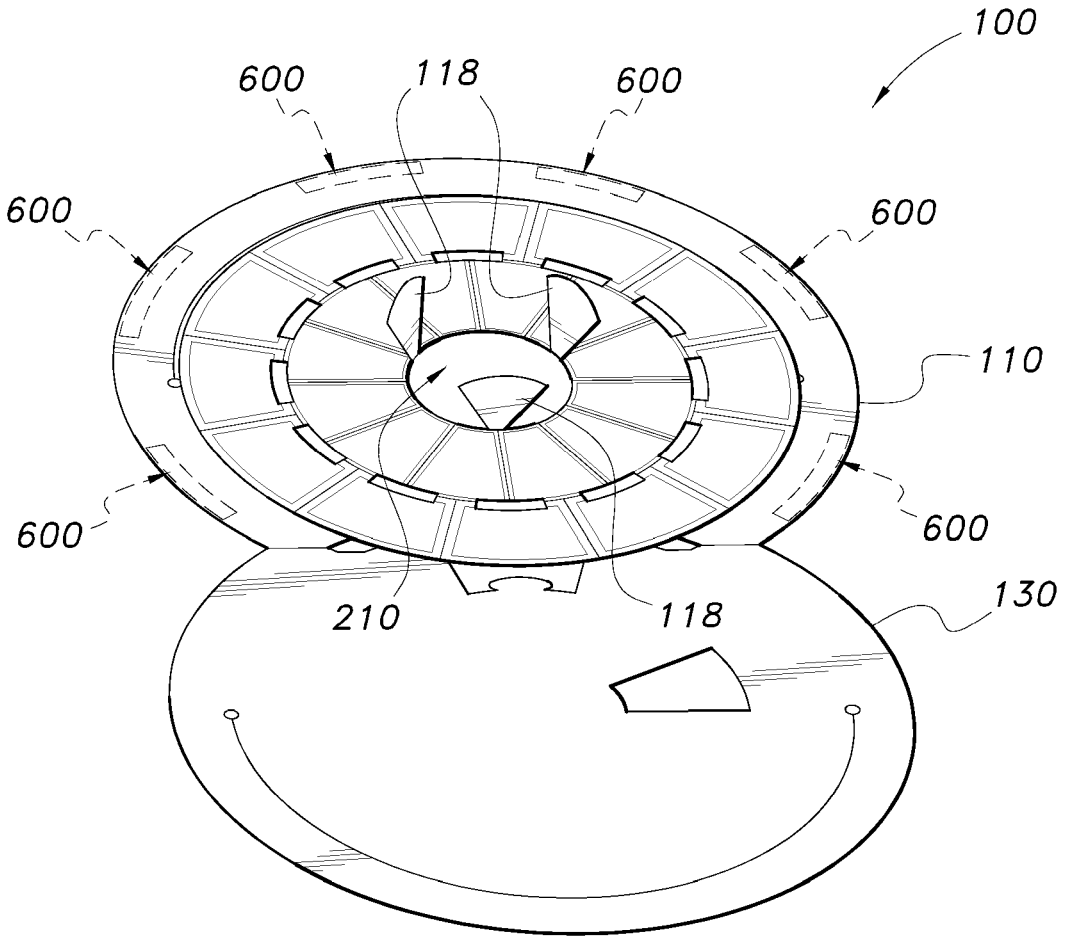
FIG. 4 shows mounting of the wheel over the raised tabs as shown in FIG. 2, according to the present invention.

FIG. 4 shows mounting of the wheel 200 over the raised tabs 118, 118, 118 as shown in FIG. 2, according to the present invention. Adhesive portions may be provided in the regions 600 disposed beyond the radius of the wheel 200, to secure outer edges of the first portion 110 to outer edges of the second portion 130. The regions 600 are merely exemplary, and the regions where adhesive is applied can be in the form of small dots; a continuous strip or line; a series of adhesive patches in arbitrary shapes; and so on. It will be understood that the adhesive can be replaced by any securing means, such as rivets, staples, additional folded portions, welding, and any other securing means which would be known to any one having skill in the assembly arts for sheet materials.

Figure 5:
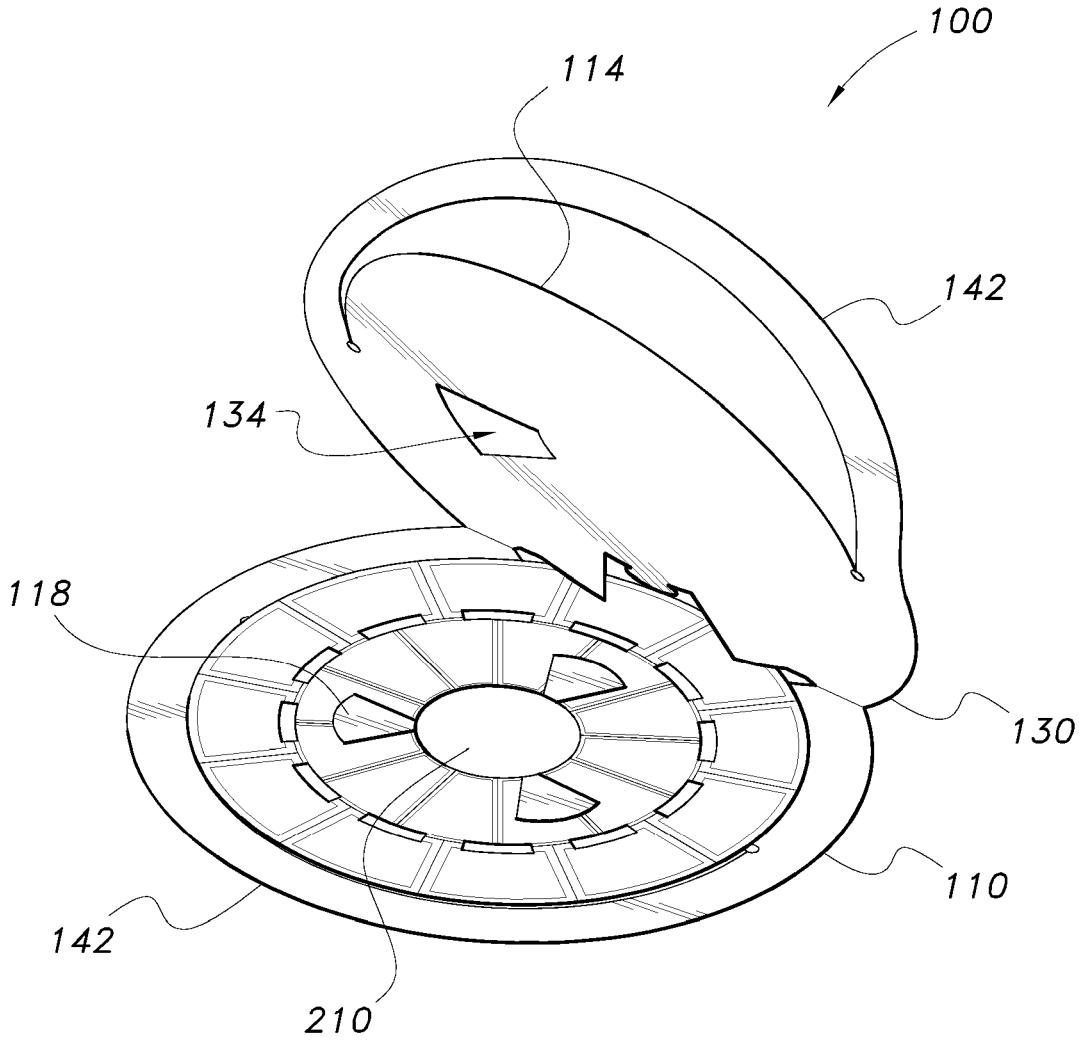
FIG. 5 shows folding of the second portion of the holder over the wheel so as to encompass the wheel between the first portion of the holder and the second portion of the holder.

FIG. 5 shows folding of the second portion 130 of the holder over the wheel 200 toward the first portion 110, so as to encompass the wheel 200 between the first portion 110 of the holder and the second portion 130 of the holder. FIG. 5 also shows the separation of the portion 142 away from the plane of the second portion 130, which forms a slot or opening to receive an edge of a thin object such as the top of a file folder or the top of an envelope.

Figure 6:
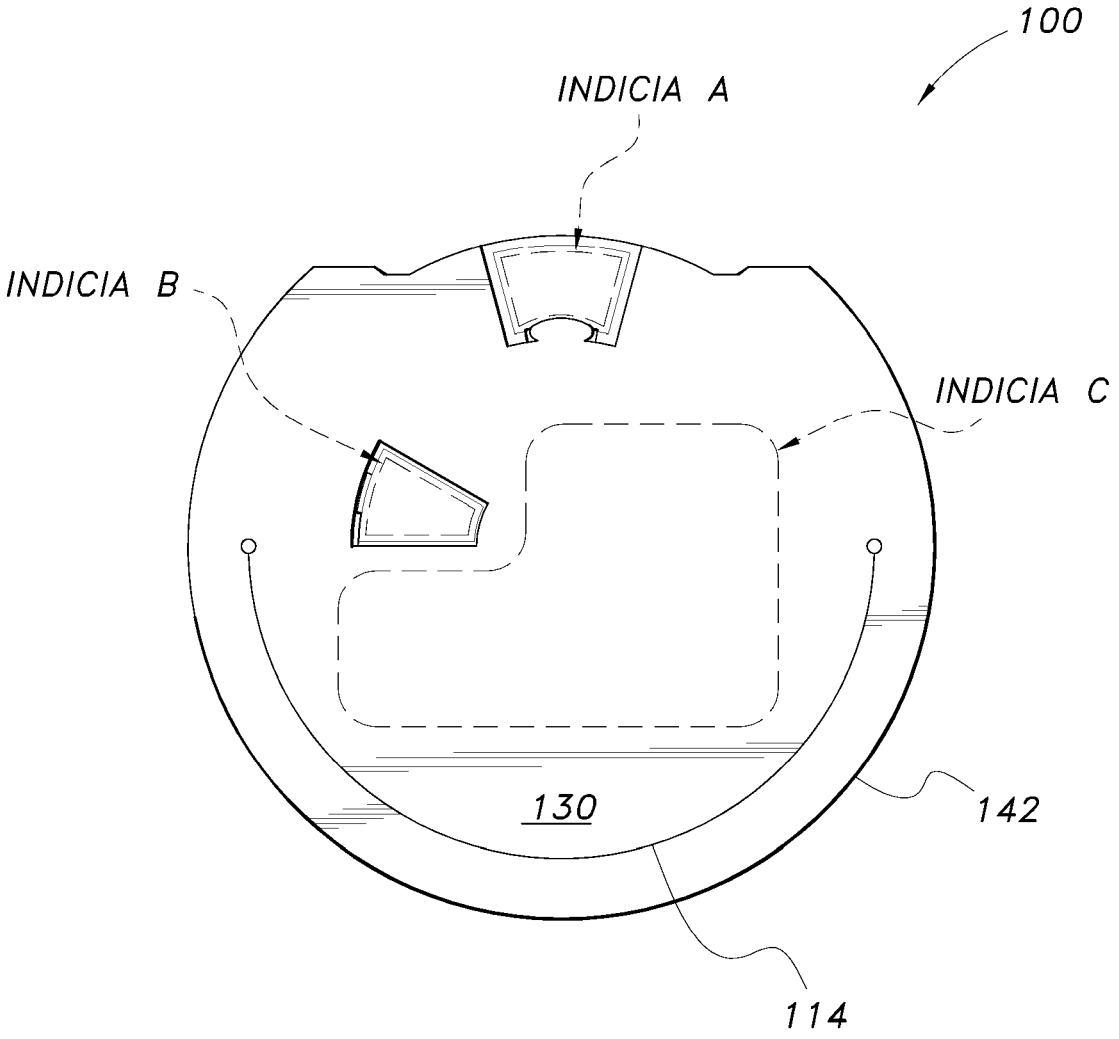
FIG. 6 is a front elevational view of the final form of the device of FIGS. 1-5, showing two windows for viewing indicia on the wheel from the outer ring and from the inner ring respectively.

FIG. 6 is a front elevational view of the final form of the device 100 of FIGS. 1-5, showing the first window (140 in FIG. 1) which is a top window through which Indicia A shows through. FIG. 6 also shows the second window (134 in FIG. 1) through which Indicia B shows through. Additionally, Indicia C is indicated as being disposed on the front surface of the device 100 (which is the front surface of the second portion 130 of FIG. 1).

Figure 7:
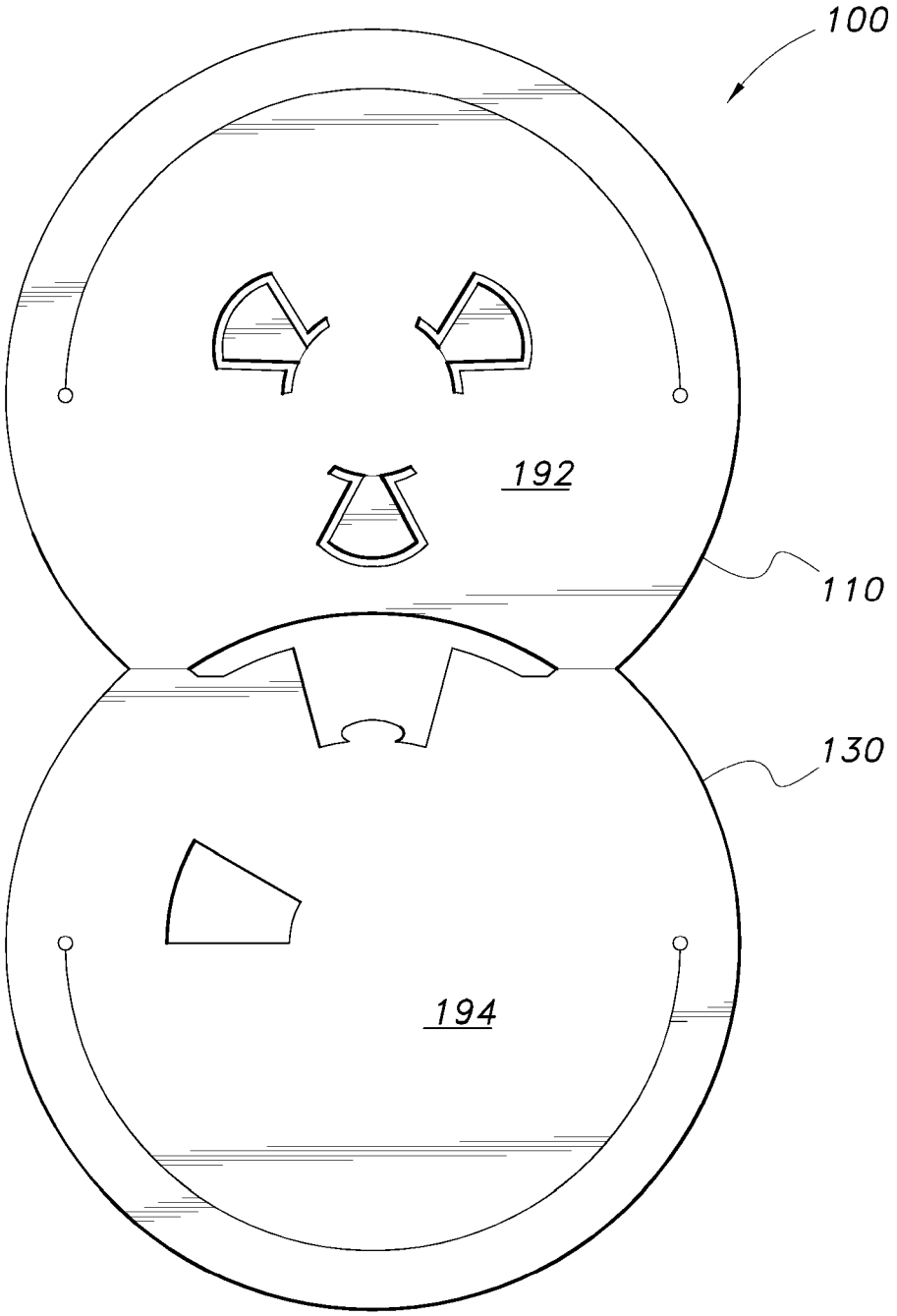
FIG. 7 is a rear elevational view of the foldable blank of FIG. 1.

FIG. 7 is a rear elevational view of the foldable blank having the portion 110 and the portion 130 of FIG. 1. Here, a rear surface 192 is visible on the portion 110, and a rear surface 194 is visible on the portion 130.

Figure 8:
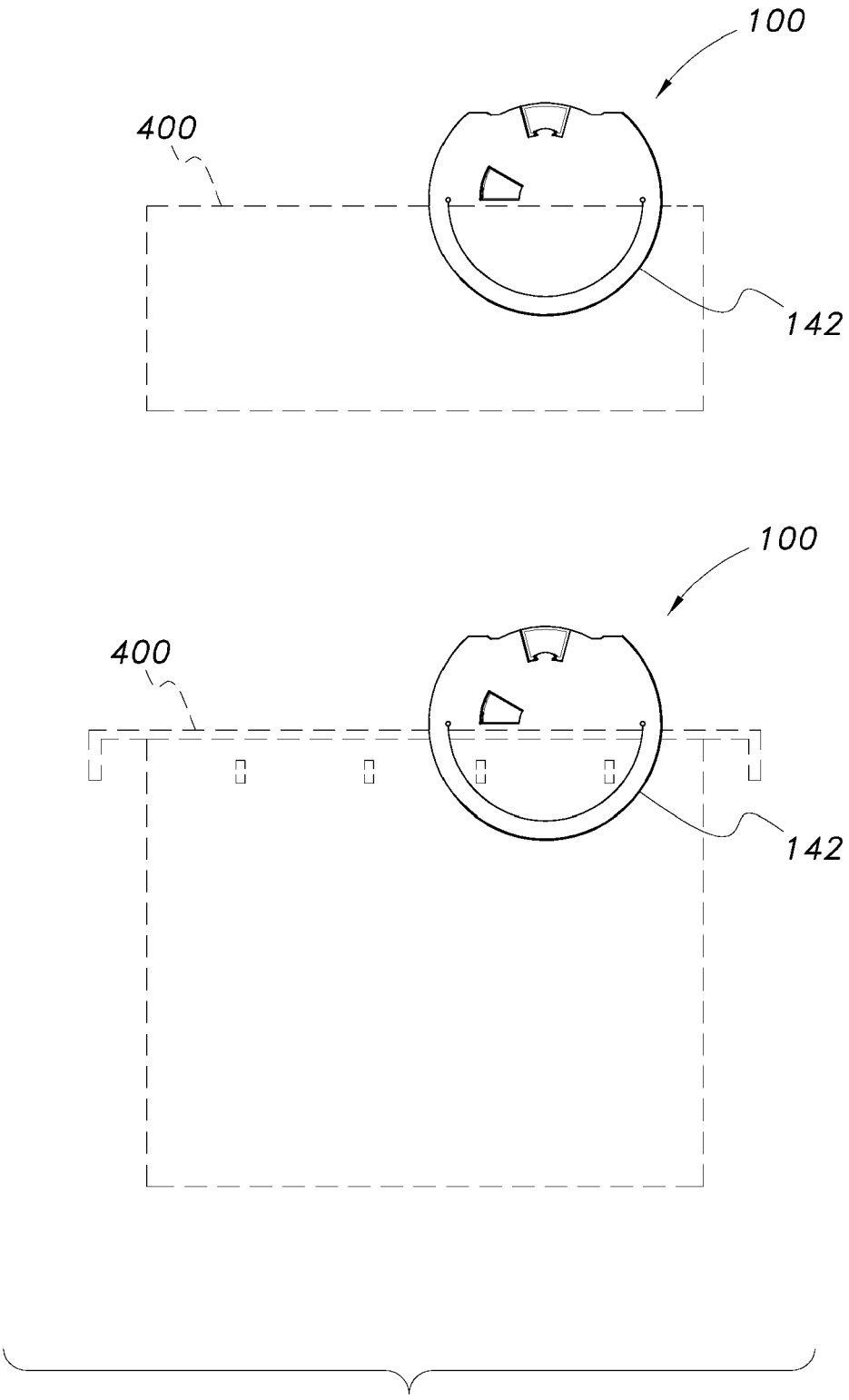
FIG. 8 schematically shows mounting of the device 100 of the present invention atop an envelope shown in phantom outline (in the upper portion of FIG. 8) and atop a file folder shown in phantom outline (in the lower portion of FIG. 8).

FIG. 8 schematically shows mounting of the device 100 of the present invention atop an envelope 400 shown in phantom outline (in the upper portion of FIG. 8) and atop a file folder 400 shown in phantom outline (in the lower portion of FIG. 8).

The device 100 as shown in FIGS. 1, 3, and 6, includes the manually rotatable wheel 200 disposed inside a holder formed by the first portion 110 and the second portion 130, the holder having first and second windows 140 and 134 respectively for viewing indicia. The rotatable wheel 200 has indicia of a first type (Indicia A) disposed on an outer ring for display through the first window 140, and has indicia of a second type (Indicia B) disposed on an inner ring of the wheel 200 for display through the second window 134. The first window 140 is a top window, and the Indicia A indicates status of the bill. The second window 134 allows viewing of the Indicia B which is explanatory of the indicia appearing in the first window 140.

The device 100 according to the present invention provides a way to organize papers, folders, and bills or invoices, for example. It is also a device 100 to set a status for such documents, such as pending, as paid, and as other types of status notations. And, it is a device 100 to provide a reminder that is inexpensive and easy to use.

The device 100, which is the Billwheel 100, has in its assembled form the rotatable disk 200 which can be manually rotated by use of the user's fingers or thumb. The Indicia A viewable at the top has a status indication (e.g. Bill Paid Off, Bill Paid in Full, etc., as shown in detail in the drawings and as explained further below). The second window 134 is a cutout in the front portion which enables viewing of an explanation of what the reminder means. The Billwheel 100 is preferably made of cardboard, thin plastic, or stiff paper, and is disposable and relatively inexpensive.

The first and second portions 110, 130 are folded to receive the inner disk 200. There are three tabs 118 that are raised up and then received within the hole in the inner wheel. They are then folded over, so that when the first and second portions (110 and 130) are folded over, the tabs 118 retain the inner disk 200 in place such that the inner disk 200 is manually rotatable.

The additional locking tab 138 at the lowermost edge of the slot 140 is foldable to be inserted into a slit 211, 212 formed in each of the reminder displays in the inner wheel. It locks the inner wheel 200 in place.

The semicircular slits 114 and 136 which are formed in the first and second portions are provided so that those portions can be bent away from the respective portions 110, 130 as shown in the drawings, so that the Billwheel 100 can be secured atop a file folder 400 or document sheet or envelope 400.

Regarding Indicia C:

In the preferred embodiment, in FIG. 6 showing the back side of the device 100, Indicia C indicated by the dashed outline labeled Indicia C in FIG. 6, is provided on the surface 130. The region shown as Indicia C is arbitrary, and any visible portion of the surface of the second portion 130 can be used. The Indicia C preferably includes instructions with schematic figures (not shown) and text. The Indicia C preferably includes the following text, which can be arranged arbitrarily in the region indicated by Indicia C.

The text preferred to be included in Indicia C is as follows:

From The Back Side Fold All 3 Axial Tabs Inwards As Shown . . . .

Position a Status Wheel, With Its Top Side Up, Over The Folded Green Axial Tabs, As Shown . . . .

Fold The 3 Axial Tabs Back Out Thru The Status Wheel's Center As Shown Flip The Bill Wheel Assembly Back Over To The Top Side As Shown . . . .

Fold & Seal The Bill Wheel Cover Together, As Shown . . . . (Edges Have Adhesive)

Exercise The Wheel In Both Directions, To Smooth Out The Axials

The Bill Wheel

Locking Tab

Select a Reminder

Adhesive On Back Edges

User Assembly Instructions

Reminder Windows Are Visible From Top Side

Regarding Indicia a and Indicia B:

In the preferred embodiment, text for the viewable region indicated by the indicia A corresponds to the outer ring text, and the viewable region indicated by the indicia B corresponds to the inner ring. In the preferred embodiment, according to the arrangement of FIG. 3, the following relationships correspond as follows:

| | | |
|---|---|---|
| Indicia A: | 232 | Bill Not Expected |
| Indicia B: | 290 | If . . . You Are Still Waiting For The Billing Statement. |

The above is exemplary, and the remaining relationships for the regions indicated by Indicia A will correspond to Indicia B as follows, with the Indicia A listed first followed by the Indicia B:

| | |
|---|---|
| 238 | Bill Received |
| 272 | If . . . You Have Received a Statement, Billing You For a Due Payment. |
| 240 | Bill Past Due Date |
| 274 | If . . . The Billing Statement Calls For a Due Date, And That Due Date Has Passed. |
| 242 | Bill Past Grace Period |

-continued

| | |
|---|---|
| 276 | If . . . The Billing Statement Allows For a Grace Period, And That Grace Period Has Passed. |
| 246 | Bill Past 30 Days |
| 278 | If . . . 30 Days Have Passed Since The Billing Statement Declared The Payment Due. |
| 248 | Bill Paid Off |
| 280 | If . . . You Have Paid The Entire Principle Balance In Full. |
| 250 | Bill Paid + Principle |
| 282 | If . . . You Have Paid The Full Amount Of The Payment Due, Plus Extra For Principle. |
| 252 | Bill Paid in Full |
| 284 | If . . . You Have Paid The Full Amount Of The Payment Due. |
| 254 | Bill Paid + Late Fee |
| 286 | If . . . You Have Paid The Full Amount Of The Payment Due, Plus Extra For Late Fees. |
| 230 | Bill Paid in Part |
| 288 | If . . . You Have Arranged And Delivered a Partial Payment Of The Due Amount. |
| 232 | Bill Not Expected |
| 290 | If . . . No Billing Statement Is Expected, Or If You Have Arranged To Defer a Payment. |
| 234 | Bill Budgeted |
| 292 | If . . . The Full Amount Needed To Pay The Expected Bill Has Been Saved. |

While indicia has been shown for indicating status of bills, other indicia can be provided for other uses. For example, indicia could be provided for use in a medical office for indicating status of patient files; in law offices for indicating status of cases; and in construction offices for indicating status of plans, employees, and/or materials; among other possible uses.

The invention being thus described, it will be evident that the same may be varied in many ways by a routineer in the applicable arts. Such variations are not to be regarded as a departure from the spirit and scope of the invention and all such modifications are intended to be included within the scope of the invention.

What is claimed is:

1. A device for indicating status, comprising:

a manually rotatable wheel;

a holder having a first portion, a second portion, and a fold line connecting said first portion and said second portion;

said wheel being disposed inside said holder, said wheel having a first type of indicia and having a second type of indicia;

said second portion of said holder having a first window for viewing said first type of indicia, and a second window for viewing said second type of indicia; and said second portion of said holder including a retaining tab, said retaining tab extending into said first window.

2. A device as claimed in claim 1, wherein said wheel has a plurality of slots disposed therein adapted to receive said retaining tab;

whereby insertion of said retaining tab in one of said plurality of slots retains said wheel in position.

3. A device as claimed in claim 2, wherein said second type of indicia is explanatory of said first type of indicia.

4. A device as claimed in claim 2, wherein said first type of indicia is disposed in an outer ring of said wheel, and said second type of indicia is disposed in an inner ring of said wheel.

5. A device as claimed in claim 1, wherein said first type of indicia indicates status of a bill, and wherein said second type of indicia is explanatory of said first type of indicia; and wherein said first type of indicia includes a plurality of status messages indicating different a respective possible status of a bill; and wherein said second type of indicia includes a plurality of explanatory messages indicating explanatory text for each of said status messages of said first type of indicia; and wherein indicia visible through said first window corresponds to explanatory indicia visible through said second window.

6. The device of claim 1, wherein said first type of indicia includes a plurality of separate status messages, wherein only a single one of said plurality of separate status messages is visible through said first window; and wherein said wheel is manually rotatable so that a user can select one of said plurality of separate status messages for viewing.

* * * * *